US008317294B2

(12) United States Patent
Morikoshi

(10) Patent No.: US 8,317,294 B2
(45) **Date of Patent: *Nov. 27, 2012**

(54) LIQUID EJECTION APPARATUS

(75) Inventor: Koji Morikoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1252 days.

This patent is subject to a terminal disclaimer.

(21) Appl. No.: 11/700,051

(22) Filed: Jan. 31, 2007

(65) Prior Publication Data

US 2007/0176963 A1 Aug. 2, 2007

(30) Foreign Application Priority Data

Jan. 31, 2006 (JP) ..... 2006-021984
Apr. 4, 2006 (JP) ..... 2006-102945

(51) Int. Cl.
*B41J 2/165* (2006.01)

(52) U.S. Cl. ..... 347/30; 347/31

(58) Field of Classification Search ..... 347/29–32
See application file for complete search history.

(56) References Cited

U.S. PATENT DOCUMENTS

| | | | | |
|---|---|---|---|---|
| 6,672,704 | B2 * | 1/2004 | Katakura et al. | 347/23 |
| 6,746,096 | B2 | 6/2004 | Sakamoto et al. | |
| 6,796,633 | B1 | 9/2004 | Kawamata et al. | |
| 2007/0188544 | A1 * | 8/2007 | Morikoshi | 347/29 |

FOREIGN PATENT DOCUMENTS

| | | | |
|---|---|---|---|
| JP | 2002-52740 | A | 2/2002 |
| JP | 2002-52744 | A | 2/2002 |
| JP | 2002-361889 | A | 12/2002 |
| JP | 2003-251828 | A | 9/2003 |
| JP | 2004-17543 | A | 1/2004 |
| JP | 2006-224420 | A | 8/2006 |

* cited by examiner

*Primary Examiner* — Kevin S Wood
(74) *Attorney, Agent, or Firm* — Sughrue Mion, PLLC

(57) ABSTRACT

A liquid ejection apparatus includes: an ejection head that ejects a liquid from a nozzle; a cap that can seal an opening of the nozzle; an absorber disposed in the cap; a first ejection unit that allows to perform a first ejection operation toward the cap for maintenance of the nozzle; a suction unit that sucks the liquid from the cap; a second ejection unit that allows to perform a second ejection operation for replenishing the cap with a liquid before the suction, and a capping unit that covers the opening of the nozzle by the cap after the second ejection operation is performed.

10 Claims, 8 Drawing Sheets

LIQUID EJECTION APPARATUS

BACKGROUND

1. Technical Field

The present invention relates to a liquid ejection apparatus which performs a drawing operation by ejecting a liquid from a nozzle of inkjet recording devices, display manufacturing devices, electrode forming devices, biochip manufacturing devices, etc.

2. Related Art

In the related art, the inkjet printers (hereinafter, referred to as 'printer') suitable for performing a printing operation on a sheet of paper is known as a liquid (ink) ejecting apparatus. Generally, the printer is configured such that a head provided with a fine nozzle for ejecting a liquid (ink) is movably arranged while facing a paper.

In the printers, if the ink in nozzle become dehydrated, it makes difficult to perform a normal ejection. Therefore, the technick or recovering from drying and suppress the drying, becomes important. Essentially, a printer has a cap for sealing (capping) a nozzle opening, so the printer is made to suppress drying of ink in the nozzle by performing capping during non-operating time.

Additionally, it is also well known printers that recovers and sustains a ejection capability by ejecting ink outside a sheet of paper when a drawing is operated at start, end or in the meanwhile and thereby exchanging to new ink from old ink which is progressed drying in a nozzle. The ejection for nozzle maintenance is called a preliminary ejection operation, and most of the ejection is performed into the cap.

In the related art, an absorber is provided to sustain ink inside the cap. The sealing space by the capping is kept in high humidity by the moisture of the ink sustained in the absorber. Nevertheless, in the printer accompanied with the preliminary ejection operation as mentioned above, sometimes the preliminary ejected ink is more accelerated drying inside nozzle when the nozzle is capped. That is, because a moisturizer (glycerin etc.) of the ink accompanied with progression of preliminary ejection history is accumulated to the absorber in condition of missing the sustaining moisture. Therefore, it acts actively to deprive of moisture from the ink in the nozzle when capping is operating.

To consider the above, first, the applicant of the present application filed about the invention related to a cap structure of no-remaining ink inside the cap. (Patent Document 1)

Patent Document 1: JP-A-2003-251828

However, in patent document 1 related to the cap, the cap suppress the trouble from moisturizer in the ink described above. By contrast there is no moisture sustaining function at the same time, as a result the cap is not possible enough to suppress drying in the nozzle under long abandoned period.

Further, in the configuration of the cap remaining the absorber, even if a forced discharge of the preliminary ejected ink by using a suction unit communicated with the cap is tried to operate, since that ink has high viscosity already to lose the large amount of moisture, the ink may not be almost ejected.

SUMMARY

An advantage of some aspects of the invention is to provide a liquid ejection apparatus capable of appropriately suppressing drying a liquid inside a nozzle in state of capping. The advantage can be attained as at least one of the following aspects.

A first aspect of the invention provides a liquid ejection apparatus comprising: an ejection head that ejects a liquid from a nozzle; a cap that can seal an opening of the nozzle; an absorber disposed in the cap; a preliminary ejection unit (first ejection unit) that performs a preliminary ejection operation (first ejection operation) toward the cap for maintenance of the nozzle; a suction unit that sucks the liquid from the cap; a replenishing ejection unit (second ejection unit) that performs a replenishing ejection operation (second ejection operation) for replenishing the cap with a liquid before the suction; and a capping unit that covers the opening of the nozzle by the cap after the replenishing ejection operation is performed.

According to the liquid ejection apparatus of the invention, after new liquid is replenished to the absorber (replenishing ejection operation) then suction is operated. Therefore old (humid component disappears and moisturizer is contained a lot) liquid accumulated to the absorber by the preliminary ejection operation is cleaned and flow out by using new liquid and thus the old liquid is appropriately discharged. A part of the replenishing liquid is sustained to the absorber. Whereby the preliminary ejected old liquid do not promote drying in the nozzle. Further in the nozzle opening when capped, the drying in the nozzle is properly suppressed by humid component of the liquid sustained to the absorber.

The humid component of liquid represents a main solvent component and, the moisturizer represents an addition component having characteristics to sustain the humid component.

Preferably, in the liquid ejection apparatus, an amount of the liquid ejected by the replenishing ejection operation is larger than an amount of moisturizing component in the liquid contained in the absorber by the preliminary ejection operation.

According to the liquid ejection apparatus of the invention, the moisturizer accumulated to the absorber can be appropriately discharged.

It is preferable that, in the liquid ejecting, the replenishing ejection unit performs the replenishing ejection operation just before a main power supply is turned off.

According to the liquid ejection apparatus of the invention, in a situation assuming that a non-operation state is left for long time, the discharge of the moisturizer in the absorber is operated, and therefore the drying in the nozzle can be properly suppressed.

It is preferable that, in the liquid ejection apparatus, a plurality of the nozzles and caps are provided to correspond to a plurality of liquid types, and the replenishing ejection unit sets an amount of the liquid ejected by the replenishing ejection operation every liquid type.

According to the liquid ejection apparatus of the invention, a humidity retention component can be efficiently washed by replenishing liquid of the proper amount every corresponding liquid type.

It is preferable that, in the liquid ejection apparatus, the suction unit performs the suction after the replenishing ejection operation is performed and a predetermined waiting time elapses.

According to the liquid ejection apparatus of the invention, by the replenishing ejection operation, the suction is operated after the elapse of the waiting time to mix the moisturizer accumulated to the absorber, therefore the moisturizer in the absorber can be efficiently discharged.

It is preferable that, in the liquid ejection apparatus, the apparatus further includes a history managing unit that manages a history related to the preliminary ejection operation, and the replenishing ejection unit performs the replenishing ejection operation under a condition based on the history.

If the history of the preliminary ejection is progressed, an old moisturizer is sustained a lot to the absorber, then drying promotion in the nozzle during capping is occurred, or it is hard to wash the humidity retention component. According to the liquid ejection apparatus of the invention, based on the history information related to the preliminary ejection operation, the moisturizer can be discharged in appropriate condition.

It is preferable that, in the liquid ejection apparatus, the replenishing ejection unit performs the replenishing ejection operation with an amount of the liquid based on the history.

According to the liquid ejection apparatus of the invention, by replenishing liquid of the proper amount every corresponding amount of the humidity retention component accumulated to the absorber, the humidity retention component can be efficiently washed.

It is preferable that, in the liquid ejection apparatus, the replenishing ejection unit performs the replenishing ejection operation at a time based on the history.

According to the liquid ejection apparatus of the invention, by performing the suction accompanied with the liquid replenishing in the proper time reflecting to the preliminary ejection history, the moisturizer in the absorber can be efficiently discharged.

It is preferable that, in the liquid ejection apparatus, the history managing unit manages information on an accumulated amount of the liquid ejected by the preliminary ejection operation.

According to the liquid ejection apparatus of the invention, based on the history information that appropriately reflecting to the state of the humidity retention component accumulated to absorber, the humidity retention component in the absorber can be efficiently discharged.

It is preferable that, in the liquid ejection apparatus, the history managing unit manages an accumulated time of a drawing operation.

According to the liquid ejection apparatus of the invention, based on the history information that appropriately reflecting to the state of the moisturizer accumulated to absorber, the humidity retention component in the absorber can be efficiently discharged.

It is preferable that, the liquid ejection apparatus further includes a drying history managing unit that manages a drying history of the liquid contained in the absorber by the preliminary ejection operation, and the replenishing ejection unit performs the replenishing ejection operation with an amount of the liquid based on the drying history.

According to the liquid ejection apparatus of the invention, the replenishing ejection operation is performed with the proper ejection amount considering the drying state of the liquid accumulated to absorber, whereby the moisturizer sustained the liquid can be efficiently discharged.

It is preferable that, the liquid ejection apparatus further includes a temperature detection unit that detects an ambient temperature, and the replenishing ejection unit performs the replenishing ejection operation with an amount of the liquid based on the ambient temperature.

According to the liquid ejection apparatus of the invention, the replenishing ejection operation is performed with the proper ejection amount considering a viscosity change of the liquid by the ambient temperature, whereby the humidity retention component in the absorber can be efficiently discharged.

The present disclosure relates to the subject matter contained in Japanese patent application Nos. JP 2006-021984 filed on Jan. 31, 2006 and JP 2006-102945 filed on Apr. 4, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, appropriate embodiment of the invention is minutely illustrated with reference to an attached drawing.

The embodiment mentioned below is, appropriate detailed examples of the invention, therefore there are technically preferable a lot of limitations. However, in description mentioned below, if there is no description about that the invention is limited, the scope of the invention is not limited to these embodiments. Also, in the reference drawings mentioned below, for convenience of an illustration, there is a case that length and width scale of a member or a portion is differently illustrated compare to a practical object.

(Configuration of Liquid Ejection Apparatus)

First Embodiment

Figure 1:
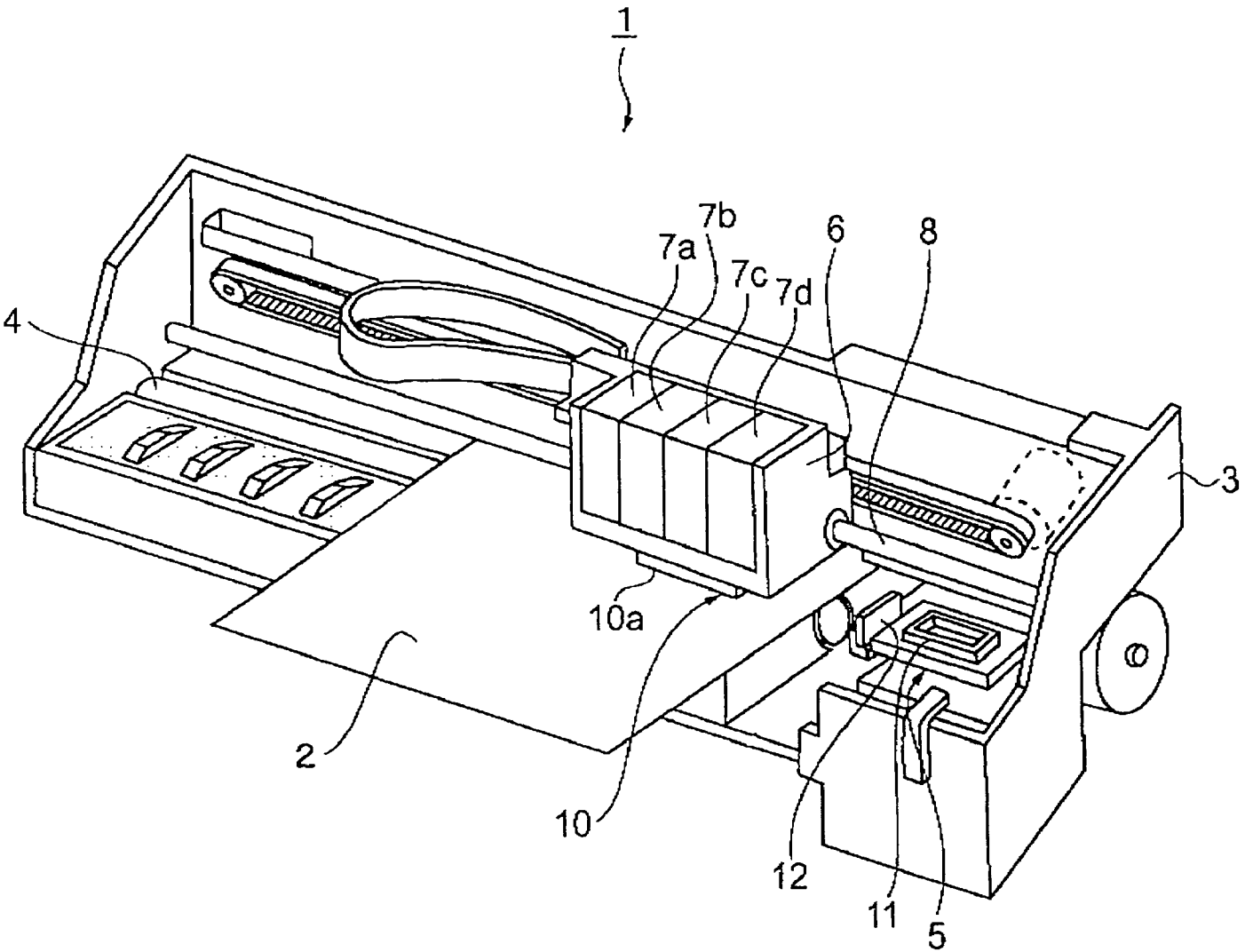
FIG. 1 is schematic perspective view illustrated a whole configuration of the liquid ejection apparatus.
Figure 2:
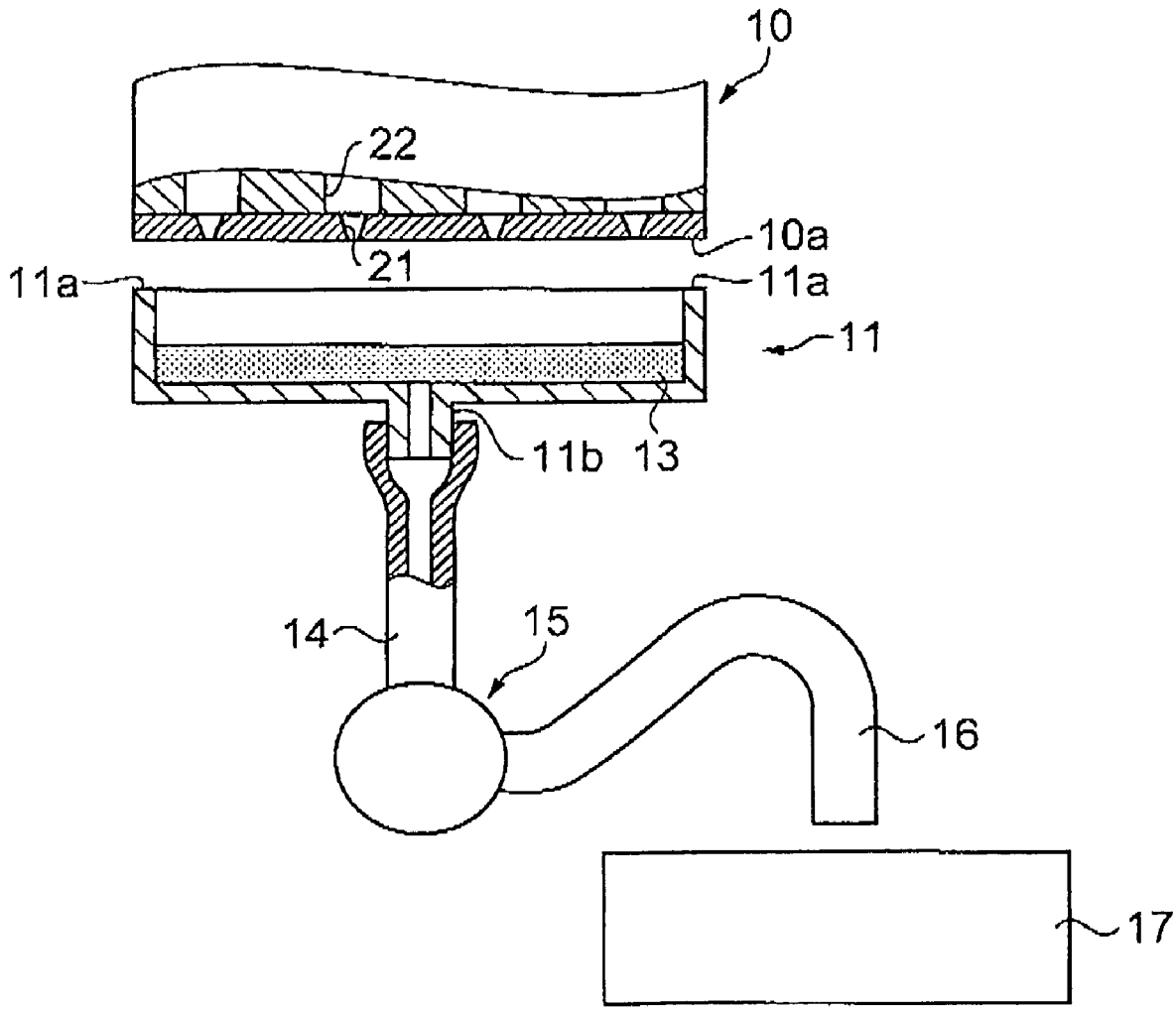
FIG. 2 is a partially-exploded side view illustrated a peripheral configuration of the cap.
Figure 3:
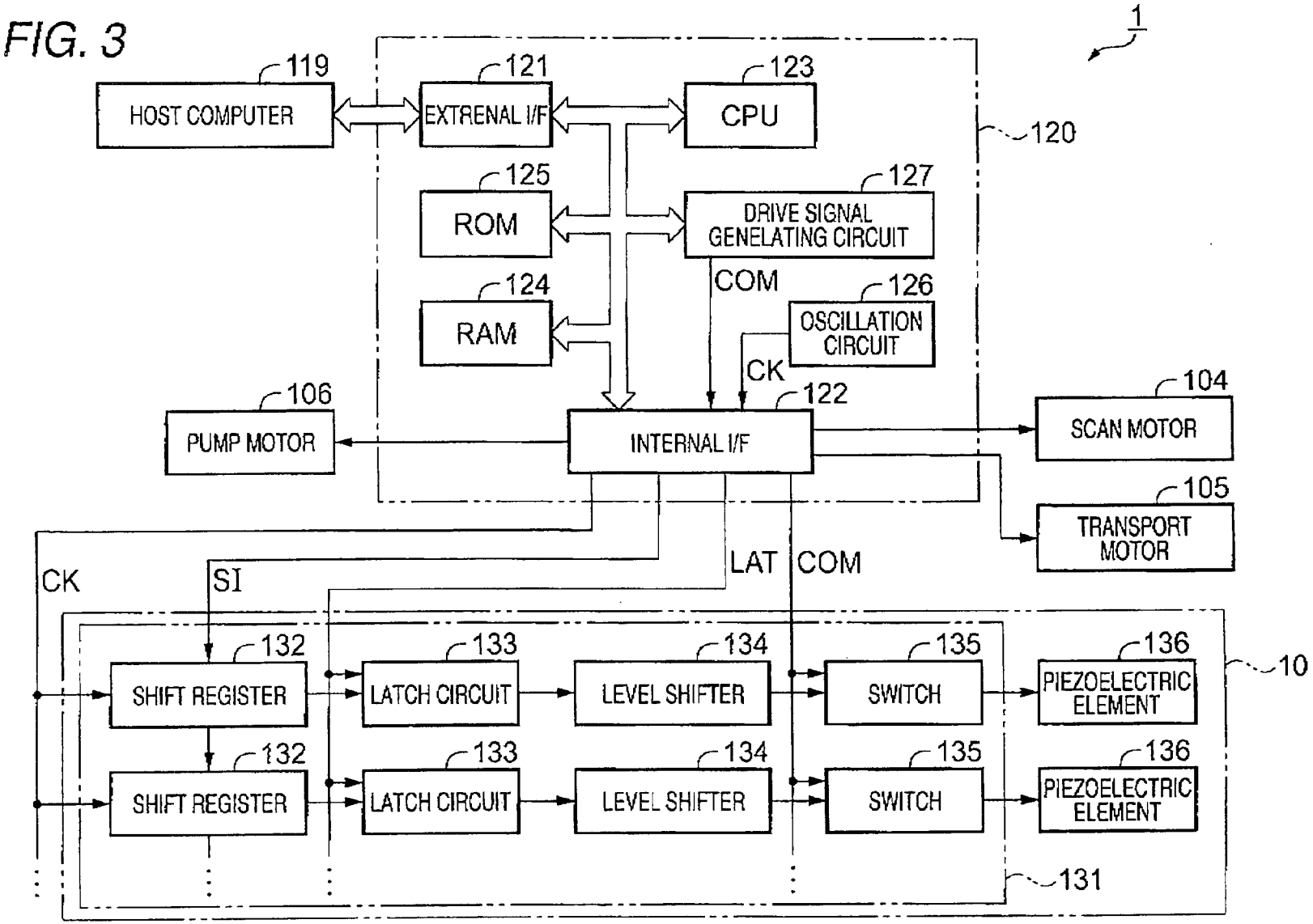
FIG. 3 is a block diagram illustrated an electrical configuration of the liquid ejection apparatus.

First, the configuration of the liquid ejection apparatus is illustrated to refer to FIG. 1, FIG. 2 and FIG. 3.

FIG. 1 is schematic perspective view illustrating a whole configuration of the liquid ejection apparatus. FIG. 2 is a partially-exploded side view illustrating peripheral configuration of the cap. FIG. 3 is a block diagram illustrating an electrical configuration of the liquid ejection apparatus.

In FIG. 1, a printer 1 as the liquid ejection apparatus, is provided with a guide frame 3 formed of steel plate, a transport roller 4 carrying a sheet of paper 2, a ejection head 10 having a nozzle surface 10*a* set up with fine nozzle in parallel, a maintenance unit 5 for maintaining the nozzle of the ejection head 10. The ejection head 10 is equipped on a carriage 6 and made to operate reciprocating motion (scanning) with following a guide road 8. A guide frame 3 sets a basis of the whole device by rigidity and weight and has a function as an electrical earth.

In the carriage 6, ink cartridges 7*a* to 7*d* that receive respectively a coloring ink of four colors as liquid is equipped and the coloring ink (ink) of each color is supplied respectively to the ejection head 10. And, performing discharge control for the each nozzle of the ejection head 10 through synchronizing with scanning of the carriage 6 and carrying of the sheet of paper 2 (drawing operation), image is formed on the sheet of paper 2 by ink liquid droplets.

The maintenance unit 5 includes, a cap 11 being capable of sealing (capping) the nozzle opening through close contacting the nozzle surface 10*a* of the ejection head 10 and a wiper blade 12 as a plate shaped member made of rubber etc. The cap 11 is available not only playing a role to protect nozzle from dust or dry, but also operating the maintenance. In addition, wiper blade 12 is available to wipe the ink sticking on the nozzle surface 10*a*.

In FIG. 2, the ejection head 10 includes a nozzle 21 set up in parallel with line shape on nozzle surface 10*a* corresponding to each ink, and a pressure generating chamber 22 that communicates to each nozzle 21. A part of the wall of the pressure generating chamber 22 is deflected by piezoelectric elements etc., and the ink is ejected by pressure generating in the pressure generating chamber 22 that is caused by operation of the piezoelectric element.

The cap 11 is a box shaped member having an opening on a side opposed to the ejection head 10. The cap 11 has elasticity at an edge portion 11*a* of the cap opening. Therefore, the opening of the nozzle 21 can be sealed (capping) by closely contacting the edge portion 11*a* to the surface 10*a*. Furthermore, inside the cap 11, an absorber 13 formed of sponge and non-woven fabric is arranged. The reason is for sustaining high humidity inside the cap 11 in state of capping by the absorber 13 having the ink sustaining function.

The cap 11 is supported by the slider apparatus not to be illustrated, and move in up down direction (direction to places both near and far from the nozzle surface 10*a*) operating together with a movement in scanning direction of the ejection head 10. Thus, the capping and the releasing of that can be performed freely by scanning control of the ejection head 10.

In a lower portion of the cap 11, a communication pipe 11*b* is formed. The communication pipe 11*b* is connected to one edge section of a communication tube 14. The communication tube 14, considering that the cap 11 is set up configuration to be possible to move by the slider apparatus, is preferable to have proper flexibility. In state of the capping, considering to form communicating space with sealing space in the cap 11, the communication tube 14 is preferable to be made of material that makes hardly vapor permeation through side walls.

The other edge section of the communication tube 14, is connected to a suction pump 15 (illustration that express schematically) as a suction unit. In the suction pump 15, tube pump that is small and has good efficiency is properly available. The suction pump 15 is capable of not only suction (suction in the nozzle) the ink from inside the nozzle 21 in capping state but also suction (suction in the cap) the pooled ink inside the cap in no-capping state. The suctioned ink is received in a waste ink tank 17 trough a waste ink tube 16 communicating with the outlet of the suction pump 15.

The suction in the nozzle, in case that the ink in the nozzle 21 is dried to be solid or impossible to discharge because of the high viscosity, discharging the dried ink by force, performed as an object to recover ejection capacity. Moreover, the suction in the cap performed as an object to recover the ejected ink in the cap 11 by suction in the nozzle or recover the ejected ink by the preliminary ejection operation (the detailed content is mentioned later).

In FIG. 3, the printer 1 includes a control unit 120 that operate various kinds of controls related to operations. The control unit 120 connected to host computer 119 through external interface (I/F) 121. Also through the internal I/F 122, the unit is connected to a ejection drive circuit 131 of the ejection head 10, scanning motor 104 to perform scanning drive of the carriage 6 (reference in FIG. 1), a transport motor 105 for driving the transport roller 4 (reference in FIG. 1), and a pump motor 106 for driving the suction pump 15 (reference in FIG. 2).

The control unit 120 includes a CPU 123, a RAM 124 functioning as a buffer memory of data related to a work memory of the CPU 123 or discharge control, a ROM 125 memorizing each kinds of control information, a transmit circuit 126 generating clock signal (CK), and a drive signal generating circuit 127 to generate drive signal (COM). The ROM 125 can be available to be capable of rewriting such as an EEPROM.

The ejection drive circuit 131 includes a shift register circuit including a shift register 132, a latch circuit 133, and a switch 135, also the drive circuit is composed to apply selectively drive signal (COM) to each of the piezoelectric element 136. The drive signal (COM) is composed by combination of pulses of electric charge and discharge.

A printing operation is performed to transmit the data such as the drawing pattern data of bitmap type that illustrate arrangement of ink drops in the sheet of paper 2 (reference in FIG. 1), to the control unit 120 from host computer 119. At that time, the control unit, decoding the drawing pattern data, generates nozzle data that is ON/OFF information of the every nozzle.

A nozzle data signal (SI) that changes from nozzle data into serial signals, synchronize the clock signal (CK) and is transmitted to the shift register circuit. As the result, the ON/OFF information of the every nozzle is memorized to each of the shift register 132. The nozzle data related to ⌈ON⌋ information latched in the latch circuit 133 by a latch signal (LAT), is transformed to pre determined voltage signal in level shifter 134 and is supplied to a switch 135.

As a result, the drive signal (COM) is applied to the piezoelectric element 136 corresponding to ⌈ON⌋ and then the ink is ejected from the nozzle. The discharge control (drawing control) based on the drawing pattern data is performed periodically through synchronizing with the scan location of the ejection head 10.

The control unit 120, in such a way to interleave the drawing control process, makes to generate the corresponding nozzle data signal (SI) or the drive signal (COM) etc. then might make to perform the preliminary ejection operation or replenishing ejection operation. That is, control unit 120 has the function as the preliminary ejection unit (first ejection unit) and the replenishing ejection unit (second ejection unit) of the invention.

Herein, the preliminary ejection operation (first ejection operation) is a ejection toward the cap 11 before and after the drawing operation or in the meanwhile as the object of the nozzle maintenance, and the ejection is performed as an object of attempting recovery and sustenance of the ejection capacity through replacing old ink in the nozzle to new ink, or improving humidity retention in case of the capping by supplying moisture to absorber 13 (reference in FIG. 2).

The replenishing ejection operation (second ejection operation) is an ejection performed for replenishing ink to the absorber 13 (reference in FIG. 2) prior to suction in the cap. The replenishing ejection operation likewise the preliminary ejection operation is the ejection performed for the cap 11 (reference in FIG. 2). Yet the replenishing ejection operation is performed with suction inside the cap. Also, an ejection amount per one operation is set up with about several to dozen times comparing to the preliminary ejection operation.

(Nozzle Maintenance of the Liquid Ejection Apparatus)

Hereinafter, the nozzle maintenance of the liquid ejection apparatus is illustrated through flow charts of FIG. 4, FIG. 5 referring to FIG. 2, FIG. 3.

Figure 4:
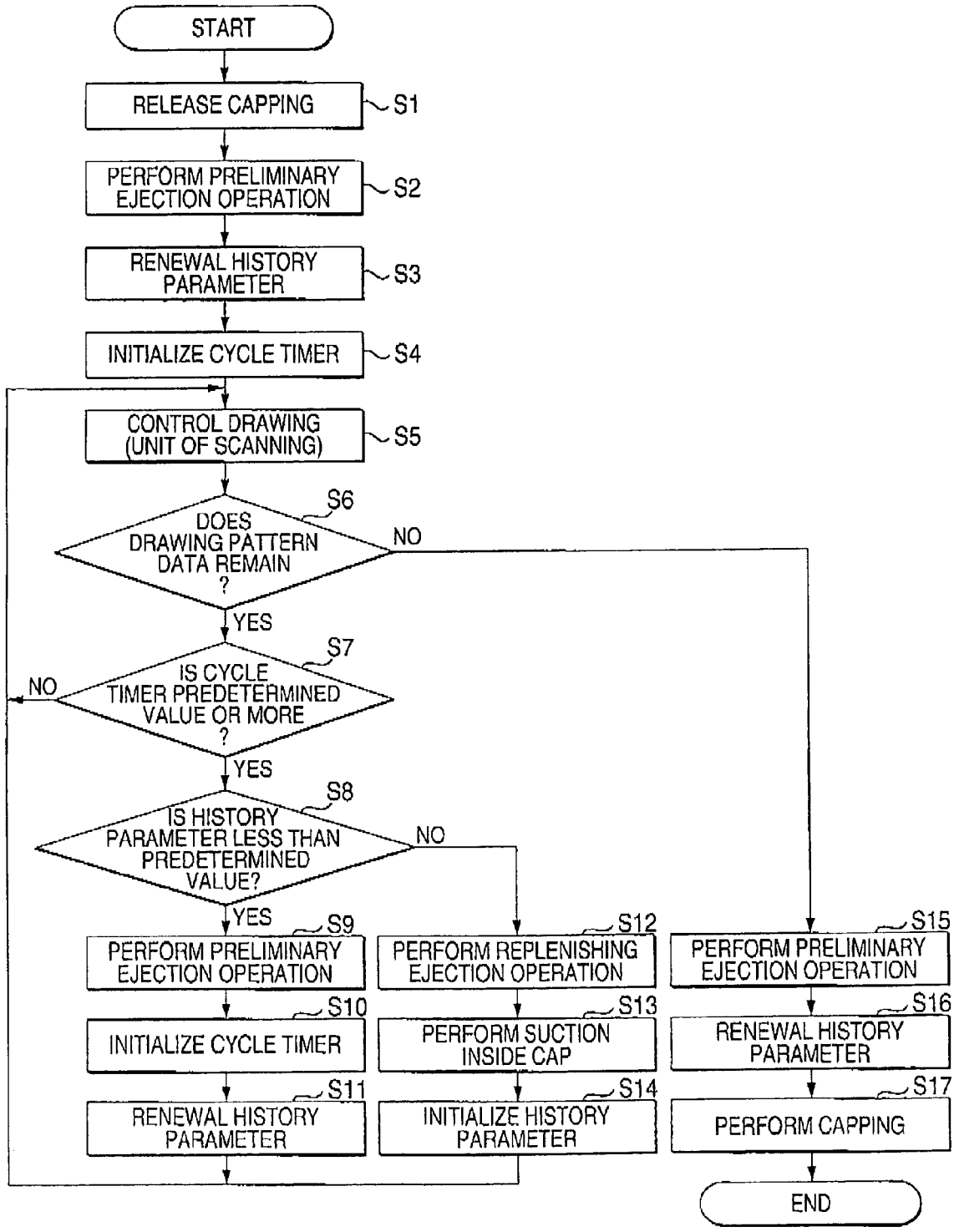
FIG. 4 is a flow chart illustrated a processing related to a drawing operation.

FIG. 4 is, a flow chart illustrating a processing related to the drawing operation. FIG. 5 is, a flow chart illustrating a processing related to nozzle maintenance at that time of main power off.

The printer 1, in non-operating time, is made in the state that the nozzle 21 is capped (capping condition). If the printer 1 receives a drawing command from the host computer 119, the printer 1 performs a processing as following with the flow chart illustrating in FIG. 4.

The control unit 120, first releases the capping by an operation of the scanning motor 104 (step S1), thereafter performs the preliminary ejection operation for the cap 11 (step S2), renewals the history parameter (step S3), and performs to initialize a cycle timer (step S4).

The preliminary ejection operation in step S2, in state of capping, is performed in an object of the recovery for the ejection capacity by ejecting the ink progressed drying from inside the nozzle 21. According to various kinds of the ink, such the preliminary ejection operation might be controlled not to operate, referring to processing time from the nearest drawing operation, the preliminary ejection operation might be controlled to decide whether the preliminary ejection operation perform or not.

The history parameter in step S3 is one illustrating to parameters about the history of the preliminary ejection, in detail, illustrating that integrate the accumulated discharge amount for the every preliminary ejection operation. The history parameter can be set up with not only the value corresponding to a number of the ejected ink drops, consuming ink amount, but also the value corresponding to the recovery (ejection drive recovery, operation recovery) of the preliminary ejection operation. In the cases, the history parameter can be set up with the value corresponding to any one of one nozzle unit, one ink kind unit, the whole nozzle unit. As mentioned before, the control unit 120 has a function as a history managing unit for managing the history of the preliminary ejection operation by the history parameter.

The cycle timer in step S4 is a timer for deciding a performance time of the preliminary ejection operation (step S9) that performs periodically in the meanwhile of the drawing operation. As illustrated in the flow chart in FIG. 4, the cycle timer is counted to set right after of the preliminary ejection operation (step S2 and step S9) as a starting time of reckoning.

After S4, the control unit 120 operates drawing control for 1 scanning amount (step S5), thereafter the unit decide whether drawing pattern data remains or not (step S6).

In step S6, when it is judged that the drawing pattern data is no remaining, the control unit 120 operates the nozzle maintenance processing (step S15 to S17) for finishing of the drawing operation. That is, after the preliminary ejection operation (step S15) inside the cap, and the renewal of the history parameter (step S16) is performed, protecting of the nozzle 21 is attempted by the capping (step S17)

In the step S15, the preliminary ejection operation is performed for moisturizing the absorber 13 in the cap 11. As the result, the sealing space in the capping state sustains a high humid state, the ink drying in the nozzle 21 is suppressed properly.

In step S6, when it is judged that the drawing pattern data is no remaining, the control unit 120 decides whether or not the cycle timer value is the predetermined value or more (step S7).

In step S7, when it is judged that the cycle timer value is less than the predetermined value, the processing mentioned above is repeated by returning to the processing of already mentioned step S5. In other words, drawing control (step S5) in unit of the scanning is repeated more than once until that the cycle timer reaches the determined value.

In step S7, when it is judged that the cycle timer value is the predetermined value or more, the control unit 120 decides whether or not the history parameter is less than a predetermined value (step S8).

In step S8, when it is judged that the history parameter value is less than predetermined value, the control unit 120 operates the nozzle maintenance processing (step S9 to S11) for sustaining ejection capacity during the drawing operation. That is, with the preliminary ejection operation in the cap 11 (step S9), it is performed the cycle timer initialization (step S10) and the history parameter renewal (step S11).

In the step 9, the preliminary ejection operation is performed in the purpose of forcedly replacing old ink in the nozzle 21 progressed drying into new ink. As the result, ink ejection of the lowest limit is secured whether or not the ejection is performed based on the drawing pattern data. Therefore, ejection capacity is sustained properly during the drawing operation.

After step S11, the processing mentioned above is repeated by returning to the processing of already mentioned step S5. Likewise, the preliminary ejection operation (step S9) is performed periodically during the drawing operation.

In step S8, when it is judged that the history parameter value is the predetermined value or more, the control unit 120 operates the processing for forcedly discharging about the accumulated ink to the absorber 13. That is, the replenishing ejection operation (step S12) into the cap 11 and the suction in the cap (step 13) are continuously performed. Herein, the expression mentioned above, "are continuously performed" is used, but that means both of the operations are performed as an integral manner, in actuality, the suction in the cap (step 13) is performed when a predetermined waiting time has elapsed after the replenishing ejection operation (step S12)

In the condition of rising history parameter value caused by the preliminary ejection operation (step S2.S9.S15) that is performed periodically, the ink included to the absorber 13 by the preliminary ejection operation is in the state of high viscosity with missing a lot of moisture. Such the old ink missing moisture, by the function of the moisturizer (glycerin etc.) of the ink inside acts to promote a drying in the nozzle 21 in the capping state. The suction in the cap of the step S13 is performed in order to discharge compulsorily the old ink that has such an unwanted effect.

The old ink having high viscosity is hard to discharge because of decrease in liquidity, in this embodiment, to perform the suction in the cap (step S13) after replenishing a lot of ink to the absorber 13 by replenishing ejection operation (step S12), the discharge capacity of the old ink has been raised. Because the accumulated old ink to the absorber 13 is cleaned by the replenishing ejected new ink and thus ejected properly. The reason providing the waiting time between the replenishing ejection operation (step S12) and the suction in the cap (step S13) is in consideration to make higher the discharge capacity for the old ink caused by mixing the new ink replenishing ejected with the old ink having high viscosity.

Further, the new ink that is replenishing ejected, after the suction in the cap (step S13), a part of the ink is sustained to the absorber 13, and plays a role to sustain the capped sealing space inside with high humidity The ink ejection amount by replenishing ejection operation (step S12), is preferably to set up larger amount than the an amount of moisturizing component of the ink accumulated to the absorber 13, and more preferably, the replenishing ejection amount is about 2 to 3 times (weight ratio) as large as the amount of moisturizing component. In the embodiment, the ink containing moisturizer in 10 to 20 weight % (according to ink types, the content ratio is different) has been available. The ink corresponding to 50% of whole ink amount that is preliminary ejected in the cap 11 is made to operate the replenishing ejection operation (step S12).

By the replenishing ejection operation (step S12) and the suction in the cap (step S13), since most of the old ink accumulated to the absorber 13 is discharged, the history parameter is initialized in step S14. Because the history parameter is an index of the accumulated ink amount to the absorber 13 by the preliminary ejection operation. In the same reason, the initialization of the history parameter is performed when the nozzle suction operation is activated for removing of the solidified ink or air bubbles inside the nozzle 21.

After step S14, the processing mentioned above is repeated again with returning step S5. That is, the forced discharge (step S12, S13) from the cap 11 of the preliminary ejected ink is performed periodically when the time reaches the predetermined value.

The periodically forced discharge (step S12, S13) of the old ink referring to the history parameter is performed in order to increase in an efficiency of the old ink discharge. The reason is, if the old ink is too much accumulated to the absorber 13, the ink replenishment of great large amount is needed for discharging the ink or the enough discharge is impossible.

The Printer 1 finishing the drawing operation is waiting the command from host computer 119 etc. in the no-operation state itself, whereby the processing of step S1 to S17 mentioned above is performed in case of receiving the re-command about new drawing. In this case, the history parameter keeps being used as an end point value of the drawing operation at the last time.

Figure 5:
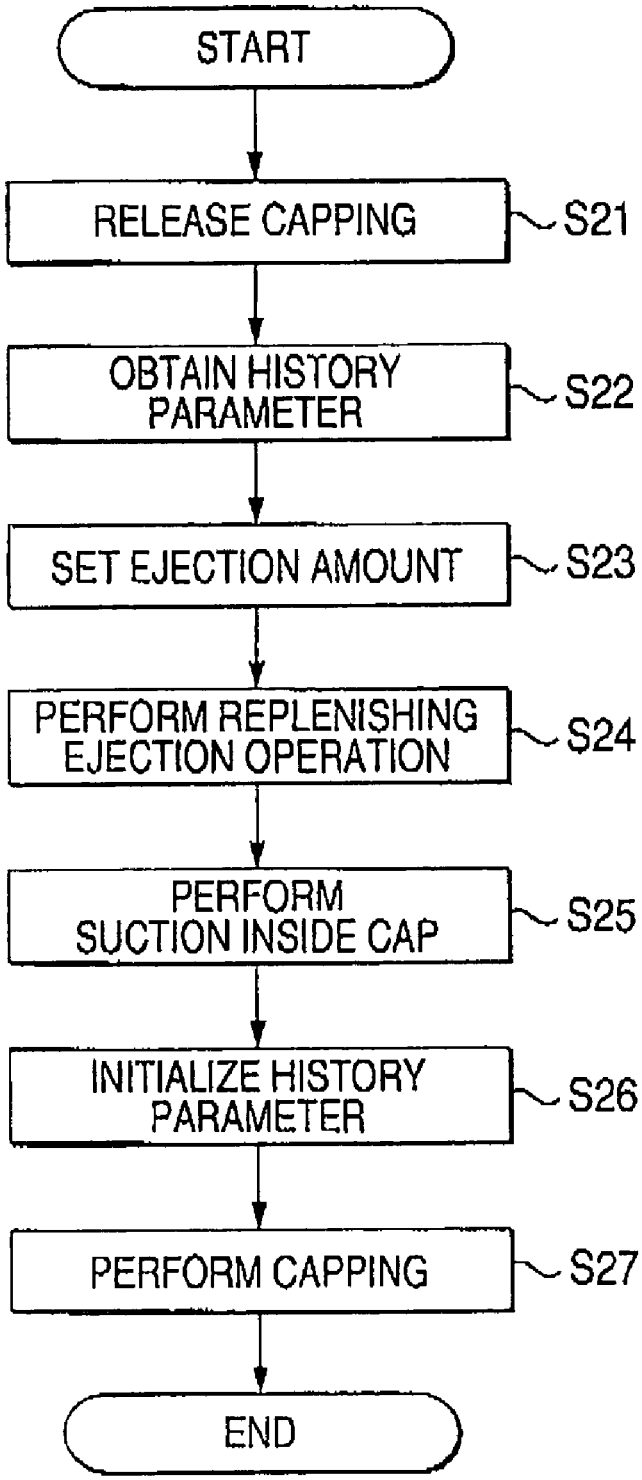
FIG. 5 is a flow chart illustrated a processing related to nozzle maintenance at that time of main power off.

On the contrary, when the main switch off operation of the printer 1 is performed by the not shown hardware switch, the printer 1 performs the processing following the flow chart illustrated in FIG. 5.

The control unit 120 first releases the capping by the drive of the scanning motor 104 (step S21). And then the unit obtains the history parameter (step S22), and based on the obtained history parameter, set up an amount of liquid ejected by the replenishing ejection operation (step S23). And, under the set ejection amount, the replenishing ejection operation (step S24) and thereafter suction in the cap (step S25) are performed. And the history parameter is initialized (step S26), then capping is performed (step S27).

Likewise, when main power is off, independent of the history parameter value at a point in time, the ink discharge operation that combines the replenishing ejection operation (step S24) and the suction in the cap (step 25) is performed. When the main power is off, thereafter it is assumed that the printer 1 does not operate for a long time. Consequently it is an object of appropriate drying prevention in the nozzle 21 caused by discharging the accumulated old ink to the absorber 13

In addition, the replenishing ejection operation in step S24 is performed based on the ejection amount set referring to the history parameter. That is, corresponding to the old ink amount accumulated to the absorber 13, the necessary and sufficient ink in order to clean the old ink is replenished. As the result, it is considered that the ink in replenishing ejection operation (step S24) is not unnecessarily wasted. Corresponding to an amount of liquid ejected by the replenishing ejection operation (step S24), the optimization is also attempted so that drive amount of the pump motor 106 related to suction in the cap (step S25) is variable.

Modified Example 1

Next, about Modified Example 1, it is illustrated as focus on differences with embodiment mentioned above following the flow chart in FIG. 6.

Figure 6:
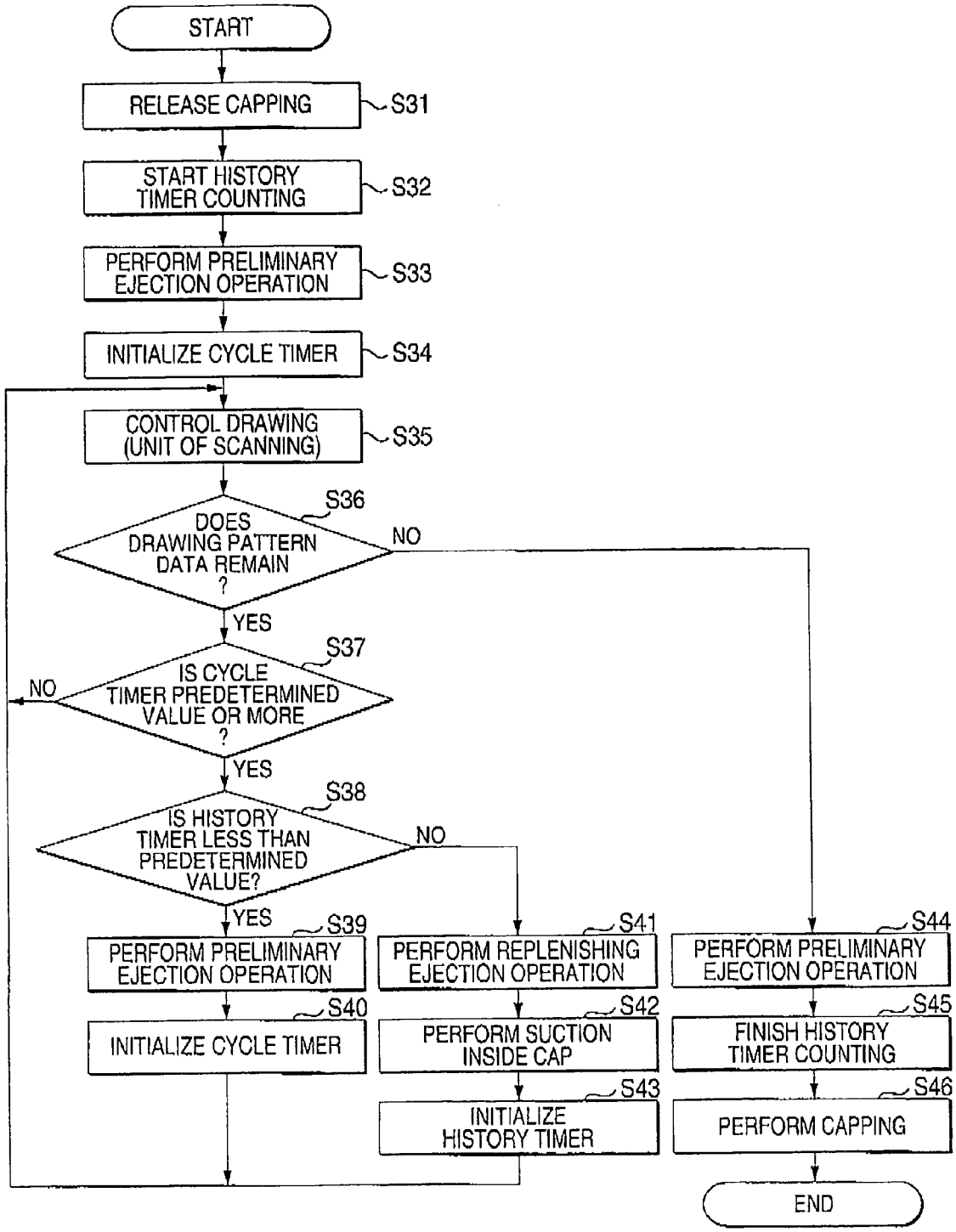
FIG. 6 is a flow chart illustrated a processing related to the drawing operation in Modified Example 1.

FIG. 6 is illustrated that the processing related to drawing operation in Modified Example 1

In Modified Example 1, about the processing related to the preliminary ejection operation (step S33, S34, S37, S39, S40, S44) or drawing control (step S35) and the processing for end judgment of drawing operation (step S36), that is the same as the embodiment mentioned before, so the description is omitted.

In Modified Example 1, the performance judgment (step S38) of the replenishing ejection operation (step S41) and the suction in the cap (step S42), is performed based on the history timer. The history timer is a timer that records accumulation of time of the drawing operation. Since the preliminary ejection operation (step S33, S39, S44) related to drawing operation generally performs in periodic, the history related to the preliminary ejection operation is counted as an indirect managing unit. As Modified Example 1, the history related to the preliminary ejection operation is possible to manage indirectly by related time and so on.

The history timer, in detail, starts the count (step S32) just after the capping release (step S31) and finishes the count (step S45) just before the capping (step S46). The history timer sustains after the one drawing operation, but the timer is initialized when the suction in the cap (step S42) or the nozzle suction operation is performed (step S43).

Modified Example 2

Next, about Modified Example 2, it is illustrated as focus on differences with embodiment mentioned above.

In Modified Example 2, the caps that perform capping the nozzle corresponding to every ink types are independently or separately provided, and made to perform the preliminary ejection operation, replenishing ejection operation or suction in the cap for every ink types. In the case, the ejection amount in the replenishing ejection operation is set up every corresponding ink types. That is, containing moisture amount is different according to corresponding ink types, whereby the differences are developed in the proper replenish ink amount required in cleansing from the absorber, therefore the unnecessary consumption of ink is suppressed by attempting the optimization in the replenishing ejection operation. In this case, the history parameter illustrating the preliminary ejection history might be allowed to count for every ink types.

The proper amount of the replenishing ink required in the old ink cleansing, since the amount is affected from the component except for the moisturizer (color material etc.), is preferably optimized considering such the fact. For example, because a pigment ink compared with a dye ink has not good characteristics in liquidity when moisture was missed, an amount of liquid ejected by the replenishing ejection operation performing for the cap corresponding to pigment ink is set up larger than an amount of liquid ejected by the replenishing ejection operation performing for the cap corresponding to dye ink.

Second Embodiment

Figure 7:
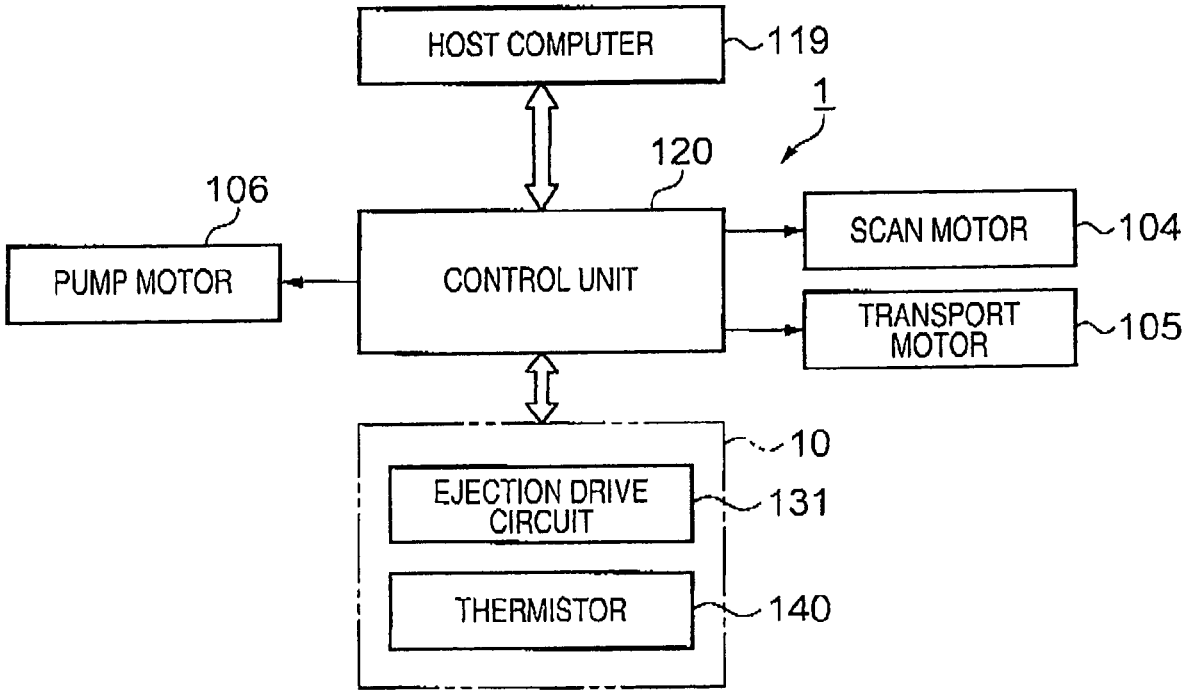
FIG. 7 is a block diagram illustrated an electrical configuration of the liquid ejection apparatus in the second embodiment.
Figure 8:
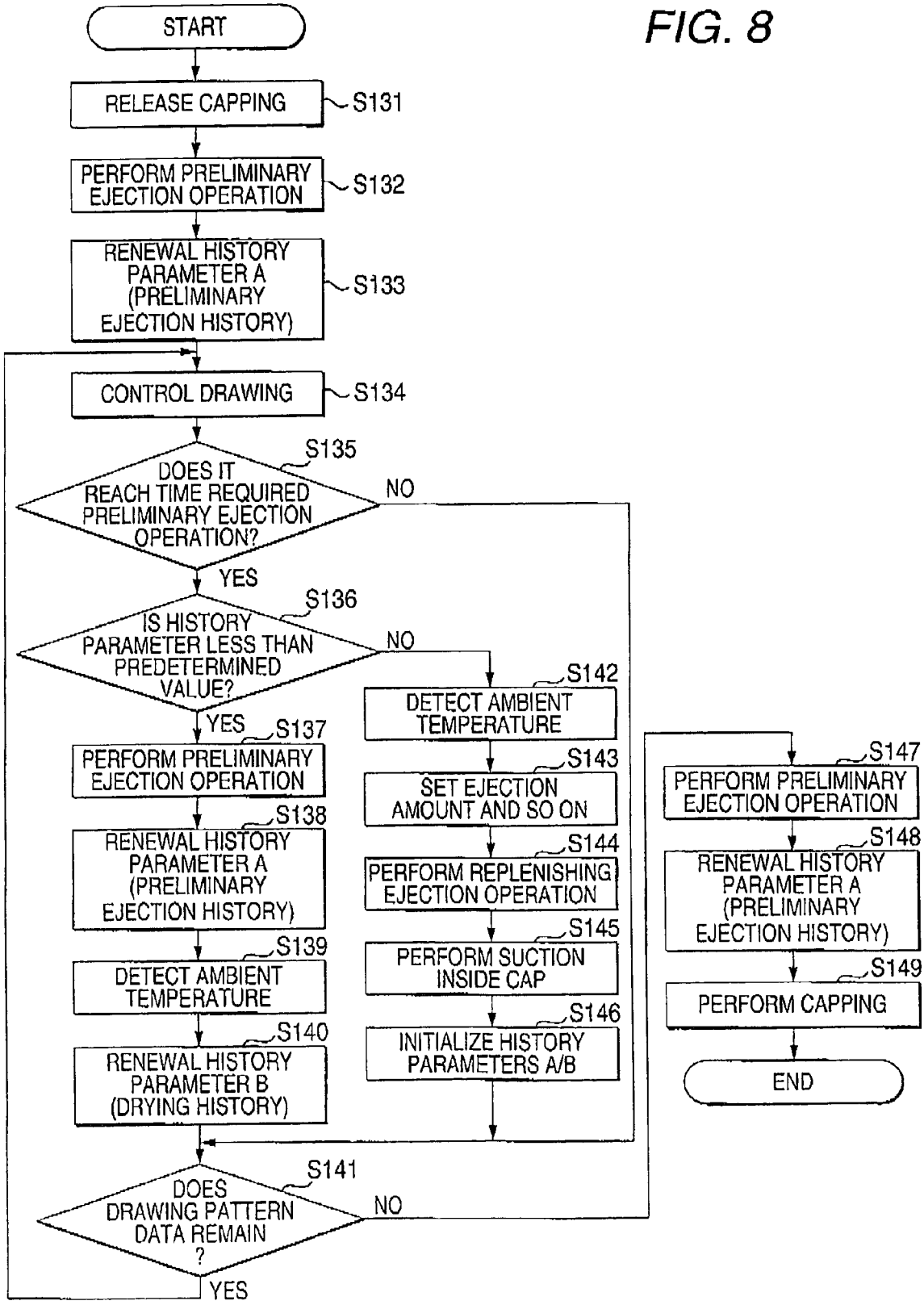
FIG. 8 is a flow chart illustrated a processing related to the drawing operation in the second embodiment.

Next, referring to FIG. 2 FIG. 7, FIG. 8, about Second Embodiment of the invention, it is illustrated as focus on differences with First Embodiment.

FIG. 7 is a block diagram illustrating that an electrical configuration of the liquid ejection apparatus in Second Embodiment. FIG. 8 is a flow chart illustrated that the processing related to drawing operation in Second Embodiment.

In FIG. 7, the printer 1 is equipped with the thermistor 140 as a temperature detection unit in the ejection head 10. Detecting a peripheral ambient temperature, operation control (the detailed content is mentioned later) based on the detected ambient temperature is performed by the control unit 120. The printer 1, receiving the drawing command from the host computer 119, operates processing related to drawing operation following the flow chart illustrated in FIG. 8.

That is, the printer 1, releases the capping (step S131), performs the preliminary ejection operation toward the cap 11 in order to operate nozzle maintenance (discharge of the ink having the high viscosity during the capping) (step S132), and renewals history parameter A (step S133). Herein, the history parameter A is, a parameter related to accumulated ejection amount of the preliminary ejection operation, as the completely same as the history parameter in the First Embodiment.

After step S133, the printer 1 performs required drawing control (step S134), whereby the printer 1 decides whether the time reaches the required preliminary ejection time (corresponding to the time that the cycle timer in first Embodiment reaches the predetermined value) or not (step S135). Herein, if the time reaches the required preliminary ejection time, then the printer 1 proceeds to step S136. If the time does not reach the required preliminary ejection time, then printer 1 proceeds to step S141 and decides whether or not the drawing pattern data remains.

In step S141, if it is judged that drawing pattern data is remained, the flow mentioned above is repeated by returning the step S134 again. if it is judged that drawing pattern data is not remained, the printer 1 performs the preliminary ejection operation (step S147) in an object to the nozzle maintenance (retention of humidity in the cap 11 during the capping), and the renewal of the parameter A (step S148), whereby the printer 1 finishes the sequence flow by the capping (step S149).

In step S136, it is judged whether or not parameter A is less than a predetermined value. In case that the history parameter is less than the predetermined value in the step S136, printer 1 performs the preliminary ejection operation (step S137) in an object of nozzle maintenance (discharge of the ink having the high viscosity during the drawing operation). Whereby printer 1 renews the history parameter A (step S138). Furthermore, the ambient temperature is detected by the thermistor 140 (step S139), and based on the detected temperature, the renewal of a history parameter B is performed (step S140).

After step S140, it proceeds to the processing for the step S141. As a result, if there is a possibility that the drawing pattern data is remained, until the history parameter A reaches predetermined value, the preliminary ejection operation (step S137) is periodically repeated. Accompanied with that, the preliminary ejected ink to the absorber 13 of the cap 11 is gradually accumulated up, also the history parameter A value that indicates the accumulated ejection amount related to the preliminary ejection operation gradually increases Herein, the history parameter B related to step S140 is, a parameter taking a charge drying history of the ink accumulated to the absorber 13 by the preliminary ejection operation, in the embodiment, a parameter reflecting to estimated value of the accumulated evaporation loss for the moisture in the ink. More in detail, assuming the moisture evaporation is caused from the absorber 13 in predetermined speed corresponding to the ambient temperature detected (step S139) by the thermistor 140, the control unit 120 calculates (renew) the accumulated evaporation loss for every performance time of the preliminary ejection operation (step S137). That is, the thermistor 140 and the control unit 120 constitutes the drying history managing unit of the invention The moisture evaporation speed based on calculating of the history parameter B, is variable value according to not only the ambient temperature but also the opening area of the cap 11 or a type of absorber 13 (material, foam, density, etc.) because of this, the control unit 120, reads out the evaporation speed data obtained by pre-experiment from ROM 125 (reference in FIG. 3), and sets up to perform calculating the history parameter B.

In step S136, when the history parameter is the predetermined value or more, the printer 1 performs the processing (step S142 to S146) that compulsorily discharges the old ink accumulated to the absorber 11 by the preliminary ejection operation. In detail, the processing is performed as mentioned below.

That is, the ambient temperature is detected by the thermistor 140 (step S142), and based on the detected ambient temperature and the history parameter B, the operation conditions (ejection amount etc.) for thereafter performed step S144 to S145 are set up (step S143). And, the replenishing ejection operation (step S144) is performed under the set operation condition, the suction in the cap (step S145) is performed when waiting time is elapsed, and thereby the old ink accumulated to the absorber 13 is discharged. Whereby, since the ink state to the absorber 13 is initialized, the history parameters A, B reflecting to the ink 2 state are initialized (step S146) and it proceeds to the processing of the step S141.

In the step S143, based on ambient temperature and history parameter B, an amount of liquid ejected by the replenishing ejection operation (step S144), awaiting time after the replenishing ejection operation, and a drive amount of the pump motor 106 for suction in the cap (step S145) are setup. In particular, the lower ambient temperature, and the larger history parameter B value (the larger accumulated evaporation), the replenishing ejection operation (step S144) is operated with the larger ejection, whereby long waiting time is passed, the drive amount is increased and the suction in the cap (step S145) is operated. The reason is that, the lower temperature, the ink (including the ink related to the replenishing ejection operation) viscosity more increases. Additionally, the more ink drying to the absorber 13 is progressed, the ink viscosity (the concentration of the moisture occupying in the ink) is more increased. Accordingly, it is considered that the ink discharge from the absorber 13 becomes difficult in that condition.

In this manner, by the printer 1 in Second Embodiment, based on the ambient temperature or the ink drying history (history parameter B) of the absorber 13, the replenishing ejection operation or suction in the cap is performed under the more fine operation condition, therefore the old ink accumulated to the absorber 13 is efficiently discharged, that drying in the nozzle is appropriately suppressed when capped.

The invention is not limited in the embodiment mentioned above.

For example, the invention is, that being the history of the preliminary ejection is an presupposition, but the aspect related to performance of the preliminary ejection operation is not limited in the embodiment mentioned above, and if there is a possibility to have an object of a nozzle maintenance, it is possible to modify and add for the a lot of variable condition.

In addition, it is possible that modify freely in the range of unchanging an intent of the invention for the replenishing ejection operation and the performance time of the suction in the cap or the judgment condition.

About liquid drying history in the absorber, considering about not only the evaporation during the drawing operation, but also the evaporation during capping, it may be possible to calculate the value. By not only the ambient temperature but also humidity history, it may be possible to manage drying history.

The invention can be applied to drawing devices using industrial way, in this case, a humid component of liquid may contain not only water but also organic solvent.

The each configuration of the each embodiment can properly combine each of them, omit or combine into another configuration not to illustrate.

What is claimed is:

1. A liquid ejection apparatus, for performing a drawing operation for ejecting liquid onto a medium, comprising:

an ejection head that ejects a liquid from a nozzle;

a cap that can seal an opening of the nozzle;

an absorber disposed in the cap;

a control unit that is configured to control performance of a first ejection operation toward the cap for maintenance of the nozzle, the first ejection operation being performed periodically while the drawing operation is executed;

a suction unit that sucks the liquid from the cap; and a history managing unit that manages history related to the first ejection operation, wherein the control unit is configured to control performance of a second ejection operation for replenishing the cap with a liquid by ejecting liquid from the nozzle toward the absorber without sealing the opening of the nozzle by the cap, before the suction, and wherein the second ejection operation is performed just before a main power supply is turned off or under a condition that is set based on the history.

2. The liquid ejection apparatus according to claim 1, wherein an amount of the liquid ejected by the second ejection operation is larger than an amount of moisturizing component in the liquid contained in the absorber by the first ejection operation.

3. The liquid ejection apparatus according to claim 1, wherein a plurality of the nozzles and caps are provided to correspond to a plurality of liquid types, and wherein the control unit is configured to set an amount of the liquid ejected by the second ejection operation every liquid type.

4. The liquid ejection apparatus according to claim 1, wherein the suction unit performs the suction after the second ejection operation is performed and a predetermined waiting time elapses.

5. The liquid ejection apparatus according to claim 1, wherein the control unit is configured to control performance of the second ejection operation with an amount of the liquid based on the history.

6. The liquid ejection apparatus according to claim 1, wherein the control unit is configured to control performance of the second ejection operation at a time based on the history.

7. The liquid ejection apparatus according to claim 1, wherein the history managing unit manages information on an accumulated amount of the liquid ejected by the first ejection operation.

8. The liquid ejection apparatus according to claim 1, wherein the history managing unit manages an accumulated time of a drawing operation.

9. The liquid ejection apparatus according to claim 1, further comprising a drying history managing unit that manages a drying history of the liquid contained in the absorber by the first ejection operation, wherein the control unit is configured to control performance of the second ejection operation with an amount of the liquid based on the drying history.

10. The liquid ejection apparatus according to claim 1, further comprising a temperature detection unit that detects an ambient temperature, wherein the control unit is configured to control performance of the second ejection operation with an amount of the liquid based on the ambient temperature.

* * * * *